US008087903B2

(12) United States Patent
Yokoyama et al.

(10) Patent No.: US 8,087,903 B2
(45) Date of Patent: Jan. 3, 2012

(54) HYDRAULIC ROTARY MACHINE

(75) Inventors: Kazuaki Yokoyama, Ibaraki (JP); Yoshinori Takeuchi, Ibaraki (JP); Haruo Kokubun, Ibaraki (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 492 days.

(21) Appl. No.: 12/310,523

(22) PCT Filed: Aug. 23, 2007

(86) PCT No.: PCT/JP2007/066357

§ 371 (c)(1),
(2), (4) Date: Feb. 27, 2009

(87) PCT Pub. No.: WO2008/026501

PCT Pub. Date: Mar. 6, 2008

(65) Prior Publication Data

US 2010/0178177 A1 Jul. 15, 2010

(30) Foreign Application Priority Data

Aug. 28, 2006 (JP) ..... 2006-230667

(51) Int. Cl.
*F04B 1/12* (2006.01)
*F04B 27/08* (2006.01)

(52) U.S. Cl. ..... 417/269; 91/499; 92/57; 92/159

(58) Field of Classification Search ..... 417/269; 91/499; 92/157, 57
See application file for complete search history.

(56) References Cited

U.S. PATENT DOCUMENTS 7,104,240 B1 * 9/2006 Vuk et al. ..... 123/193.2
2005/0172646 A1 * 8/2005 Kawabata et al. ..... 62/114

FOREIGN PATENT DOCUMENTS

JP 59058171 A * 4/1984
JP 05039775 A * 2/1993
JP 06330849 A * 11/1994

* cited by examiner

*Primary Examiner* — Nimeshkumar Patel
*Assistant Examiner* — Glenn Zimmerman
(74) *Attorney, Agent, or Firm* — Antonelli, Terry, Stout & Kraus, LLP.

(57) ABSTRACT

In a hydraulic rotary machine having rotational shaft provided within a casing a rotational shaft, a cylinder block rotationally interlocked with the rotational shaft and formed with a plural number of cylinder bores, and pistons slidably received in the cylinder bores and adapted to slide back and forth within the cylinder bores while the rotational shaft and the cylinder block are put in rotation in synchronism with each other, a multitude of minute pits are formed at least either on sliding surfaces on the side of the cylinder bores, each one of the minute pits are in an elliptical shape defining a moderately sloped surface in one side and an acutely sloped surface in the other side, and the moderately sloped surfaces of the minute pits are oriented to face a direction in which said pistons are put in sliding movement in said cylinder bores under a greater load than in the other direction.

9 Claims, 6 Drawing Sheets

HYDRAULIC ROTARY MACHINE

TECHNICAL FIELD

This invention relates to a hydraulic rotary machine such as a piston type hydraulic pump or hydraulic motor.

TECHNICAL BACKGROUND

In swash plate type or bent axis type hydraulic pumps or hydraulic motors and radial piston type hydraulic pumps or hydraulic motors, a piston is slidably fitted in each one of cylinder bores on a cylinder block which is coupled with a rotational shaft. For example, in the case of a swash plate type hydraulic pump, a cylinder block is accommodated within a casing, and a swash plate is disposed face to face with the cylinder block. A rotational shaft is extended through the swash plate and coupled with the cylinder block for rotation therewith. A plural number of cylinder bores (normally an odd number of cylinder bores, e.g., 5 or 7 cylinder bores) are formed in the cylinder block at intervals in the rotational direction. Shoes of the same number as the cylinder bores are connected with the respective pistons and held in sliding engagement with the swash plate.

Upon driving the rotational shaft, the cylinder block is put in rotation along with the rotational shaft, putting the pistons in the respective cylinder bores in reciprocating movements in a certain stroke range depending upon the angle of the swash plate. By rotation of the cylinder block, each one of the cylinder bores is connected either to an intake port or an output port in a switching fashion. Namely, as a piston is projected out of a cylinder bore, which cylinder bore is connected to an intake port to suck in operating oil. On the other hand, as a piston is retracted inward of a cylinder bore, which cylinder bore is connected to a discharge port to deliver pressurized oil.

In a swash plate type hydraulic pump as described above, it is necessary for a smooth operation of the pump to improve the quality of sliding performances of sliding surfaces on the respective pistons and cylinder bores. In order to lessen sliding friction between sliding surfaces, it has been proposed to form a sliding layer of a low friction copper alloy on sliding surfaces of cylinder bores in Patent Literature 1 below. In the case of Patent Literature 1, a sliding layer is formed by depositing a low friction copper alloy on inner sliding surfaces of a cylinder bore, followed by sintering to minimize sliding friction.

However, in order to form a low friction copper alloy layer on inner surfaces of cylinder bores as mentioned above, it becomes necessary to resort to a complicate deposition process which would result in an undesirable increase in production cost. In this regard, taking into consideration that a casing of a hydraulic rotary machine is entirely filled with operating oil when in operation, it would be more advantageous to utilize the operating oil as a lubricant in improving the sliding friction between a piston and a cylinder bore rather than resorting to a complicate low friction layer deposition process. For this purpose, it is a paramount requisite to form and constantly maintain a filmy layer of operating oil on inner sliding surfaces of each cylinder bore which are in sliding contact with a piston. Namely, inner surfaces of a cylinder bore should have a high oil retaining capacity.

In this regard, Patent Literature 2 below teaches an example of imparting oil retaining properties to a sliding surface. Namely, Patent Literature 2 teaches to improve oil retaining properties of plane sliding surfaces of engine shift forks by forming thereon a multitude of micro dimples. Further, Patent Literature teaches that micro dimples of this sort can be formed by a cutting, grinding or plastic texturing operation or otherwise by shot peening.

Patent Literature 1: Japanese Laid-Open Patent Appln. H7-167041

Patent Literature 2: Japanese Laid-Open Patent Appln. 2001-280494

DISCLOSURE OF THE INVENTION

Problem(S) Solved by the Invention

Gathering from the foregoing, it is conceivable to improve sliding movement of pistons in cylinder bores of a cylinder block by forming a multitude of micro dimples or the like on sliding surfaces of cylinder bores on the basis of teachings of Patent Literature 2, instead of resorting to a complicate deposition process to a low friction copper alloy layer on inner surfaces of cylinder bores as in Patent Literature 1.

By the way, when a hydraulic rotary machine of this sort is in operation, a cylinder block as well as pistons which are fitted in the respective cylinder bores on the cylinder block are revolved about a rotational shaft, and, concurrently and in step with revolving movements, the pistons are axially reciprocated in the respective cylinder bores. Further, shoes which are coupled with fore protruding ends of the respective pistons are held in sliding contact with a swash plate. Thus, when the hydraulic rotary machine is put in operation, the pistons are reciprocated within the respective cylinder bores under various loads of different directions, which have complicate influences on operating conditions of the machine. In a piston stroke, a largely varying pressure is applied to an end face of the piston, and the speed of displacement of the piston is varied by the rotational speed of the cylinder block. In a case where the hydraulic rotary machine is a variable displacement hydraulic pump, the stroke length of each piston is varied by the tilt control.

As gathered from the foregoing, micro dimples which are formed on inner surfaces of cylinder bores can contribute to some extent in improving oil retaining properties and in improving sliding performances of pistons in the respective cylinder bores. However, taking into consideration the severity of operating conditions, in addition to a reduction in sliding friction, it is desired to establish more favorable operating conditions. With a view to improving performance of a hydraulic rotary machine, the present inventors have conducted an intensive study and found that the quality of sliding performances of pistons can be improved furthermore by imparting functions of a fluid bearing to a sliding surface or surfaces between each piston and cylinder bore in addition to enhancement of oil retaining capacity, in such a way as to keep straight directionability of sliding movements of pistons.

In view of the foregoing, it is an object of the present invention to provide a hydraulic rotary machine with piston sliding surfaces which are improved in anti-abrasion and anti-fretting properties by a simple machining operation to ensure smooth reciprocating movements of pistons in the respective cylinder bores.

Means for Solving Problem(s)

According to the present invention, in order to achieve the above-stated objective, there is provided a hydraulic rotary machine having within a casing a rotational shaft, a cylinder block rotationally interlocked with said rotational shaft and formed with a plural number of cylinder bores, and pistons slidably received in said cylinder bores and adapted to slide back and forth within said cylinder bores while said rotational shaft and said cylinder block are put in rotation in synchronism with each other, characterized in that the hydraulic rotary machine comprises: a multitude of minute pits formed at least either on sliding surfaces on the side of the cylinder bores on the cylinder block or on sliding surfaces on the side of the pistons, each one of the minute pits being in an elliptical shape defining a moderately sloped surface in one side and an acutely sloped surface on the other side; the moderately sloped surfaces of the minute pits being oriented to face a direction in which the pistons are put in sliding movement in the cylinder bores under a greater load than in the other direction.

In this instance, between two surfaces which are in sliding contact with each other, so-called wedge film effects are produced in case a gap space between the two sliding surfaces is narrowed down in a sliding direction, that is to say, in case a gap space between the two sliding surface is narrowed down by inclination of one surface toward the other in a sliding direction, because intervening lubrication oil is squeezed and drawn in by an inclined surface. As a result, a pressure is generated between the two sliding surfaces in such a way as to push one surface away from the other in the fashion of a fluid bearing. In order to produce the wedge film effects in a more enhanced manner, the angle of sloped surfaces of the minute pits is a key factor. Therefore, instead of forming the minute pits in the shape of a bowl crater, they are each formed in an elliptical shape having a moderately sloped surface of a predetermined inclination angle from one end toward a deepest point in an appropriately oriented direction. On the other hand, each minute pit is shaped with an acutely sloped surface from the deepest point toward the other end of the pit. These minute pits are formed at least on one of the two sliding surfaces, over the entire areas of a sliding surface, with the longer axes of the elliptical pits oriented in the direction of reciprocating sliding movements of a piston.

More specifically, the moderately sloped surfaces of minute pits are oriented to face a direction in which a piston is put in a sliding movement under greater pressure or load than in the other or opposite direction. In a case where the hydraulic rotary machine is a hydraulic pump, a piston is acted by a higher pressure on its end face when it is in an inward discharge stroke going into a cylinder bore. On the other hand, in a case where the hydraulic rotary machine is a hydraulic motor, a piston is acted by a higher pressure on its end face when it is in an outward stroke coming out of a cylinder bore. Accordingly, the moderately sloped surfaces of minute pits on a hydraulic pump are oriented in the opposite direction as compared with the direction of orientation on a hydraulic motor.

For example, the minute pits can be formed by shot peening, namely, by bombarding accelerated small hard balls against a machining surface by the use of a projection device. Generally, shot peening is resorted to for roughening and hardening a superficial layer of a machining surface with a view to improving abrasive resistance or reducing fluid resistance by imparting a high residual stress to the machining surface. A surface which is formed with dimples by shot peening is improved in oil retaining capacity. According to the present invention, in addition to the foregoing points, sloped surfaces are formed by shot peening for the purpose of producing so-called wedge film effects. Namely, shot material is bombarded against a machining surface from an oblique direction, that is to say, with an angle of incidence which is inclined relative to a machining surface. The angles of sloped surfaces can be adjusted by varying the angle of incidence of shot material. A multitude of small pits are formed over the entire areas of a machining surface. The angle of incidence of shot material is preferably smaller than 60 degrees, and more preferably in a range between 45 degrees and 30 degrees, and the diameter of shot balls is preferably in a range between 10 μm and 1 mm. Of course, minute oblique pits which are formed on a machining surface by oblique shot peening have a predetermined depth which is sufficient for enjoying the anti-abrasive and oil retaining properties as mentioned above.

Machining surfaces to be treated by shot peening include an inner peripheral sliding surface of a cylinder bore and/or an outer peripheral sliding surface of a piston. Namely, minute pits may be formed on one of sliding surfaces of a cylinder bore and a piston. Alternatively, minutes pits may be formed on both of the sliding surfaces.

Effects of the Invention

The minute oblique pits which are formed on a machining surface simply by obliquely bombarding shot material as explained above contribute not only to imparting a high oil film retaining capacity to a sliding surface but also to produce effects of a fluid bearing between sliding surfaces of a cylinder bore and a piston to guarantee smooth sliding movements under a lighter load.

BEST MODE FOR CARRYING OUT THE INVENTION

Figure 1:
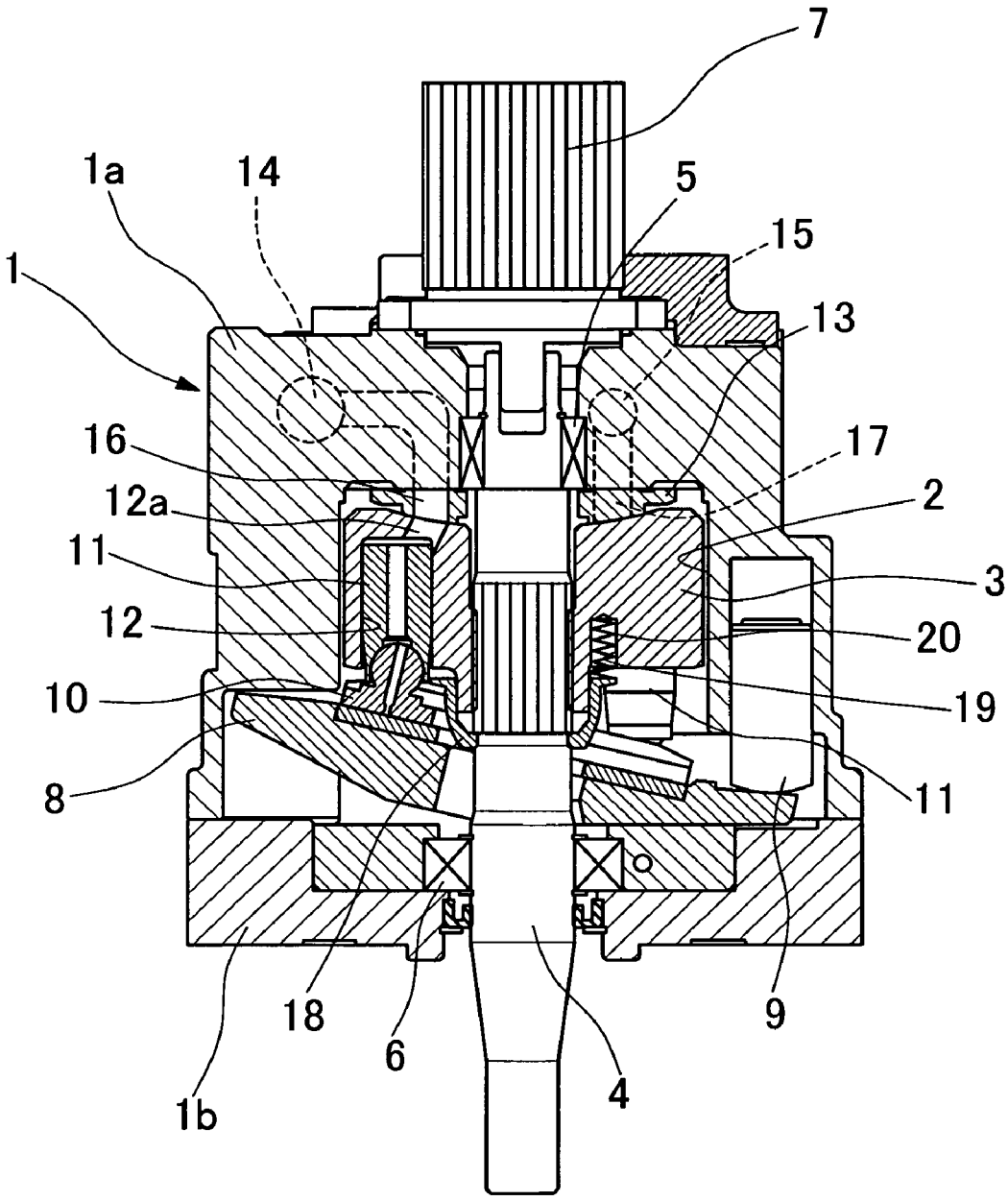
FIG. 1 A schematic sectional view of a swash plate type hydraulic pump adopted in an embodiment of the present invention as a typical example of hydraulic rotary machine.

Hereafter, the invention is described more particularly by way of its preferred embodiments with reference to the accompanying drawings. Shown in FIG. 1 is a swash plate type hydraulic pump as an example of hydraulic rotary machine. Needless to say, the present invention is not limited to a swash plate type hydraulic pump as shown in the drawing, but is similarly applicable to bent axis type or radial piston type hydraulic pumps or motors having reciprocating pistons in cylinder bores on a cylinder block which is put in rotation when in operation.

Figure 2:
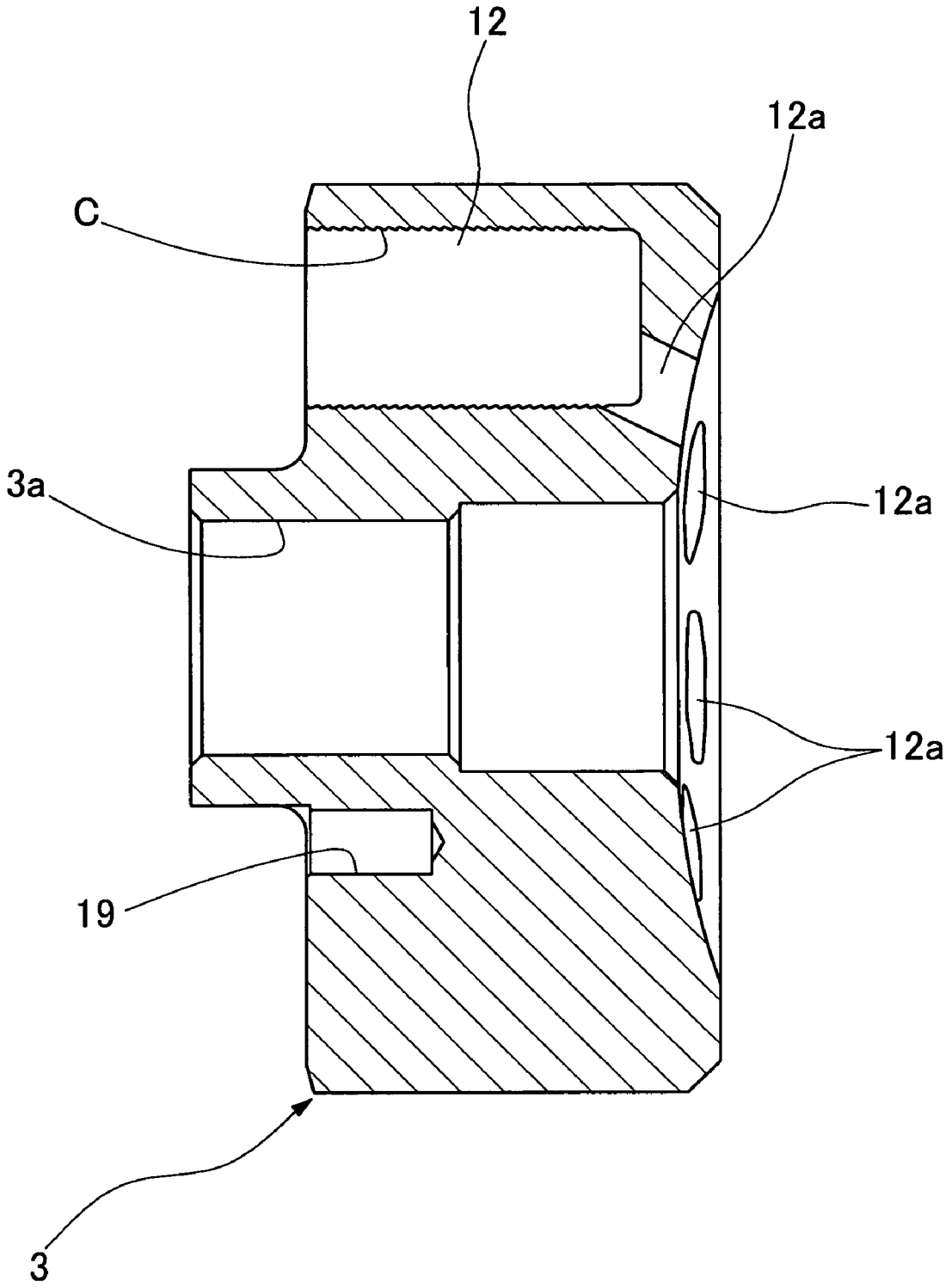
FIG. 2 A schematic sectional view of a cylinder block of the hydraulic pump shown in FIG. 1.

In the drawings, indicated at 1 is a pump casing which is composed of a main casing 1*a* and a front casing 1*b*. The main casing 1*a* is fixedly joined with the front casing 1*b* to internally define a closed accommodation space 2 internally of the pump casing 1. As seen in FIG. 2, in the accommodation space 2 of the pump casing 1, a cylinder block 3 is mounted on a rotational shaft 4 which is passed through and locked in a spline bore 3*a* at the center of the cylinder block 3. The rotational shaft 4 is rotatably supported on the main casing 1*a* and front casing 1*b* of the pump casing 1 through bearings 5 and 6. By interlocking engagement with a spline on the part of the rotational shaft 4, the cylinder block 3 is integrally rotated with the rotational shaft 4 when the latter is driven into rotation. For example, an output shaft of an engine is connected to a coupling member 7 which is provided on the part of the rotational shaft 4 for rotation with the latter.

In the drawings, indicated at 8 is a swash plate which is tilted to a certain tilt angle relative to the rotational shaft 4 under control of a tilt angle control member 9 which is provided in the main casing 1*a* in association with the swash plate 8 to determine a discharge rate of the hydraulic pump. Mounted on the swash plate 8 are a predetermined number of shoes 10 which are each connected to a piston 11 through a spherical joint 10*a*. Each piston 11 is slidably fitted in one of cylinder bores 12 which are formed in the cylinder block 3, for reciprocating sliding movements therein. An odd number of cylinder bores 12, for example, five or seven cylinder bores 12 are formed at angularly spaced positions on the cylinder block 3, and a piston 11 is fitted in each one of these cylinder bores 12.

Interposed between the cylinder block 3 and the main casing 1*a* is a valve plate 13 which is provided with an intake port 16 and a discharge port 17 in communication with an intake passage 14 and an delivery passage 15, respectively. Thus, by one revolution of the cylinder block 3, a communication passage 12*a* which is in communication with the respective cylinder bores 12 is switched from the intake port 16 to the output port 17 or vice versa. For the purpose of pressing the cylinder block 3 against the valve plate 13 and pressing the valve plate 13 against the main casing 1*a*, a compression spring 20 is set in each one of spring holes 19 which are bored in a number of angularly spaced positions on the cylinder block 3, the compression springs 20 being retained in the respective positions by a spring retainer 18 which is fixedly fitted on the rotational shaft 4.

The above-described swash plate type hydraulic pump is put in operation in the manner as follows. Namely, as the rotational shaft 4 is rotationally driven by a drive means which is not shown, the cylinder block 3 on the rotational shaft 4 is put in rotation together with the rotational shaft 4, revolving the pistons 11 on the respective cylinder bores 12 around the rotational shaft 4. At this time, the shoes 10 which are coupled with the respective pistons 11 are dragged and caused to slide on a surface of the swash plate 8. When the swash plate 8 is tilted relative to the rotational shaft 4, the pistons 11 are reciprocated in the respective cylinder bores 12 over a stroke range which is determined according to the tilt angle of the swash plate 8.

In a first half revolution of the cylinder block 3, the pistons 11 are displaced outwards and projected from the respective cylinder bores 12. Conversely, in a second half revolution of the cylinder block 3, the pistons 11 are displaced inwards and retracted into the respective cylinder bores 12. In this instance, when the pistons 11 are in a outward stroke, the respective cylinder bores 12 are communicated with the intake passage 14 of the valve plate 13 through the communication passage 12*a* (i.e., an intake stroke). When the pistons 11 are reversed at a maximally projected position and put in an inward stroke, the respective cylinder bores 12 are communicated with the discharge passage 15 of the valve plate 13 through the communication passage 12*a* (i.e., a discharge stroke). There is a dead point between the intake stroke and the discharge stroke, where the respective cylinder bores 12 are communicated with neither one of the intake passage 14 and the discharge passage 15.

Thus, when a cylinder bore 12 is in communication with the intake passage 14, the internal volume of the cylinder bore 12 is expanded by an outward displacement of the piston 11, sucking in operating oil into the cylinder bore 12 through the intake port 16. On the other hand, when the cylinder bore 12 is in communication with the discharge passage 15, the internal volume of the cylinder bore 12 is reduced by an inward stroke of the piston 11, pressurizing operating oil in the cylinder bore 12 to deliver pressure oil to the discharge port 17 by a pumping action.

In this instance, in step with revolutions of the cylinder block 3, the pistons 11 are reciprocated in the cylinder bores 12, holding the shoes 10 in sliding contact with the swash plate 8. When a piston 11 is in an intake stroke sucking low-pressure operating oil into the cylinder 12, there is no possibility of a sliding motion of the piston being met by an extremely large resistance because the piston 11 is not under the influence of any high pressure in particular during an intake stroke.

Figure 3:
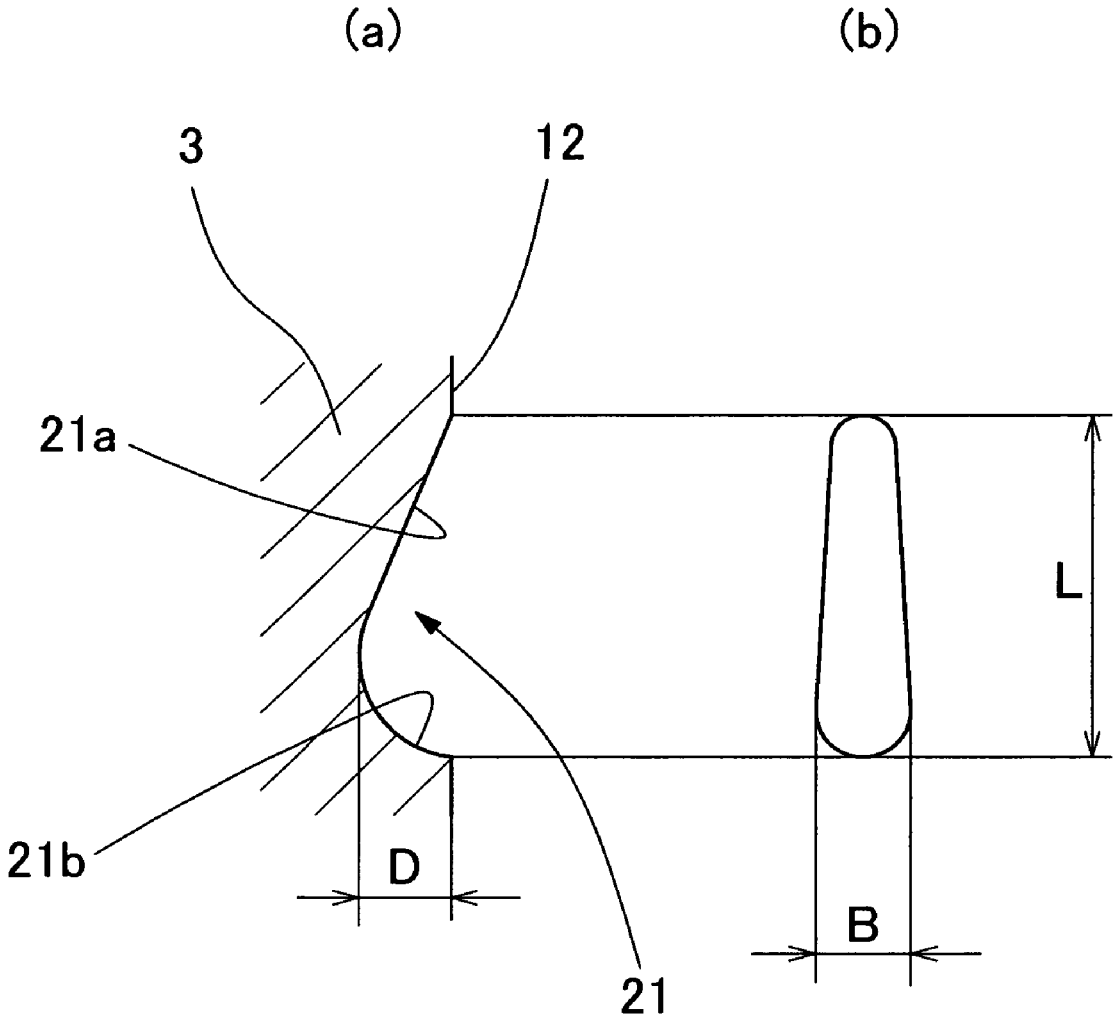
FIG. 3 A schematic illustration of one of minute pits which are formed in cylinder bores on the cylinder block.

On the other hand, when the piston 11 is in a discharge stroke, namely, in an inward sliding movement pressurizing operating oil in the cylinder bore 12, the pressurized operating oil acts on an end face of the piston 11. Therefore, it is this inward sliding movement that needs higher lubrication for putting the piston 11 in a smooth sliding movement free of large resistances and with less possibilities of abrasive wear and galling. For this purpose, as shown at C in FIG. 2, the inner surface of the cylinder bore 12 is roughened substantially in the entire areas. The roughened surface C contains a multitude of minute pits 21 which are formed, for example, in a superficial layer substantially in the entire areas of an inner peripheral sliding surface of each cylinder bore 12. As shown in section in FIG. 3(*a*), each one of the minute pits 21 is profiled to have a moderately sloped surface 21 and an acutely sloped surface 21*b* on the opposite sides of a deepest sunken bottom. In a plan view, each one of the minute pits 21 is formed in an elliptical shape as shown in FIG. 3(*b*). In this instance, the acutely sloped surface 21*b* can be so shaped as to rise approximately at right angles with a sliding surface of the cylinder bore 12 in a shape akin to a saw tooth in section. However, complicate machining operations can be required to form each minute pit 21 in a profile akin to a saw tooth. Therefore, as described in greater detail hereinafter, it is desirable to form the minute pits 21 in a more facilitated manner by oblique shot peening. In the case of oblique shot peening, the acutely sloped surface 21*b* on the side away from the moderately sloped surface 21 is inclined to a certain degree relative to a sliding surface of the cylinder bore 12.

Figure 4:
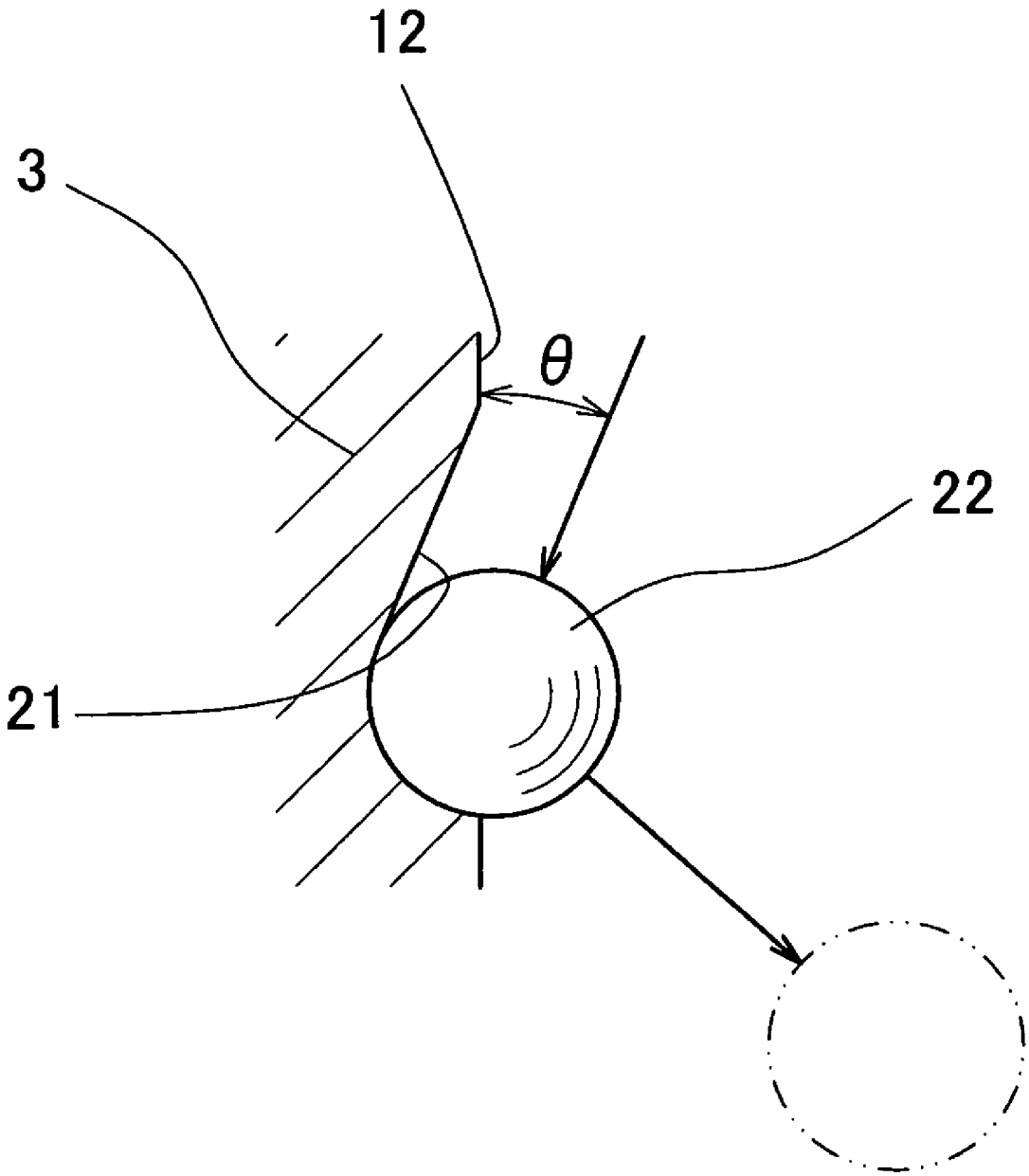
FIG. 4 A schematic illustration of a minute pit being formed by shot peening.

The minute pits 21 can be formed by oblique shot peening, for example, in the manner as shown in FIG. 4. From a nozzle (not shown) of a shot peening machine, small round balls 22 of hard material are bombarded against an inner sliding surface of each cylinder bore 12 from an oblique direction. By so doing, a multitude of minute oblique pits 21 can be easily formed on the inner surface of the cylinder bore 12 in a uniformly dispersed state. Small round balls 22 are bombarded not from a direction normal to the inner surface of the cylinder bore 12 but from an oblique or slant direction with an angle of incidence θ which is inclined relative to the inner sliding surface of the cylinder bore 12. Thus, each one of the minute pit is formed obliquely to have a moderately sloped surface 21*a* from an end on the side of a point of incidence and an acutely sloped surface at the other opposite end. In this instance, the angle of incidence of small shot balls 22 is preferred to be approximately 45 degrees or in a range between 60 degrees and 30 degrees. Further, the small shot balls 22 are preferred to be of a diameter in the range between 10 μm and 1 mm.

For instance, in a case where shot balls 22 of 10 μm are used, the minute oblique pit 21 in FIG. 3 has a width B of around 10 μm, and has a length L of between 50 μm to 100 μm and a depth D of several micrometers, depending upon the angle of incidence of the shot ball 22. A multitude of these minute pits 21 are formed on the inner surface of each cylinder bore 12, in the entire areas to be brought into sliding contact with a piston 11. These minute pits 21 may be uniformly distributed over the entire inner surface areas, but may be formed in a higher density in the vicinity of the piston-protruding end of the cylinder bore 12 in consideration that sliding movement of the piston 11 becomes instable to a maximum degree when it is extended out to a maximum degree from the cylinder bore 12.

By forming a multitude of minute oblique pits in a dispersed state on the inner surface of each cylinder bore 12 in the manner as described above, the pistons 11 can be maintained in a highly lubricated state as they slide into and out of the respective cylinder bores 12 and put in smoother sliding movements under a lighter load, and are improved in anti-abrasion and anti-galling properties to a significant degree. In this instance, operating oil is filled in the cylinder block accommodation space 2 within the casing 1 and distributed to the entire sliding portions of the pistons 11 and cylinder bores 12. However, if the sliding portions are insufficient in oil retaining capacity, breakdown of oil films may occur during operation of the pistons 11, especially when the hydraulic pump is in a discharge stroke in which the respective pistons are caused to slide under high conditions. Nevertheless, by the minute pits 21 which are formed on the inner surface of each cylinder bore 12, a higher oil retaining capacity is imparted to sliding surfaces to prevent breakdown of oil films.

By the way, in order to let the minute pits 21 perform simply the function of boosting the oil retaining capacity, it is not important to orient the minute pits 21 in a particular direction, and the respective minute pits 21 may be formed in a round shape instead of an elliptical shape. In addition to the just-mentioned function of boosting oil retaining capacity, the minute pits 21 can perform a function as a sort of fluid bearing in securing straight directionability of sliding movements of the pistons 11 which are reciprocated within the respective cylinder bores 12 on the revolving cylinder block 3, in association with the shoes 10 which are connected to the respective pistons 11 and put in sliding movement on and along a surface of the swash plate 8. Thus, as compared with a case where simply an oil film is formed on a sliding surface, the function as a fluid bearing can contribute to improve the wear-resistant and galling-resistant properties all the more to ensure smoother sliding motions of the pistons 11.

Figure 5:
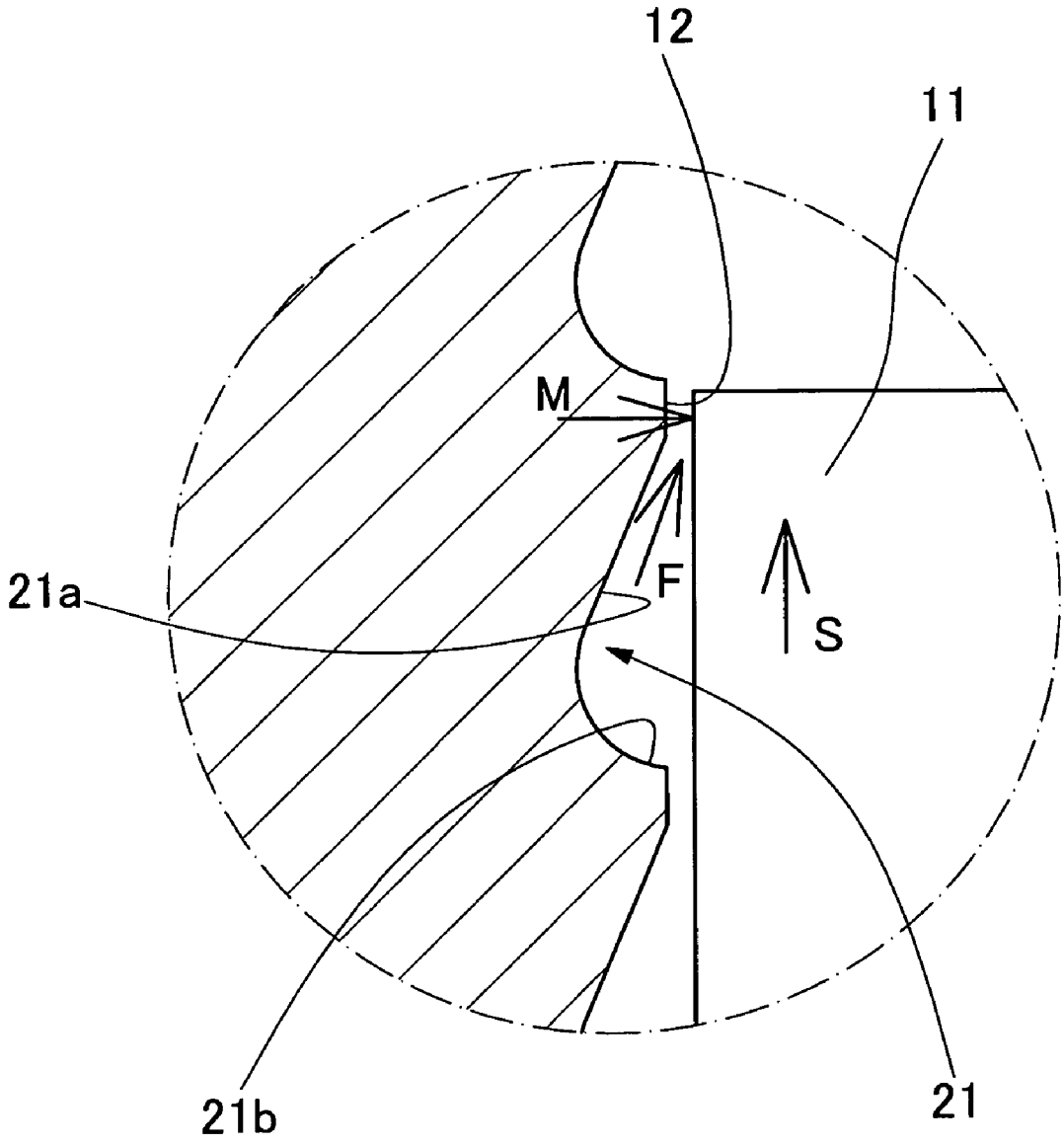
FIG. 5 A schematic illustration explanatory of wedge film effects produced by each one of minute pits.
Figure 6:
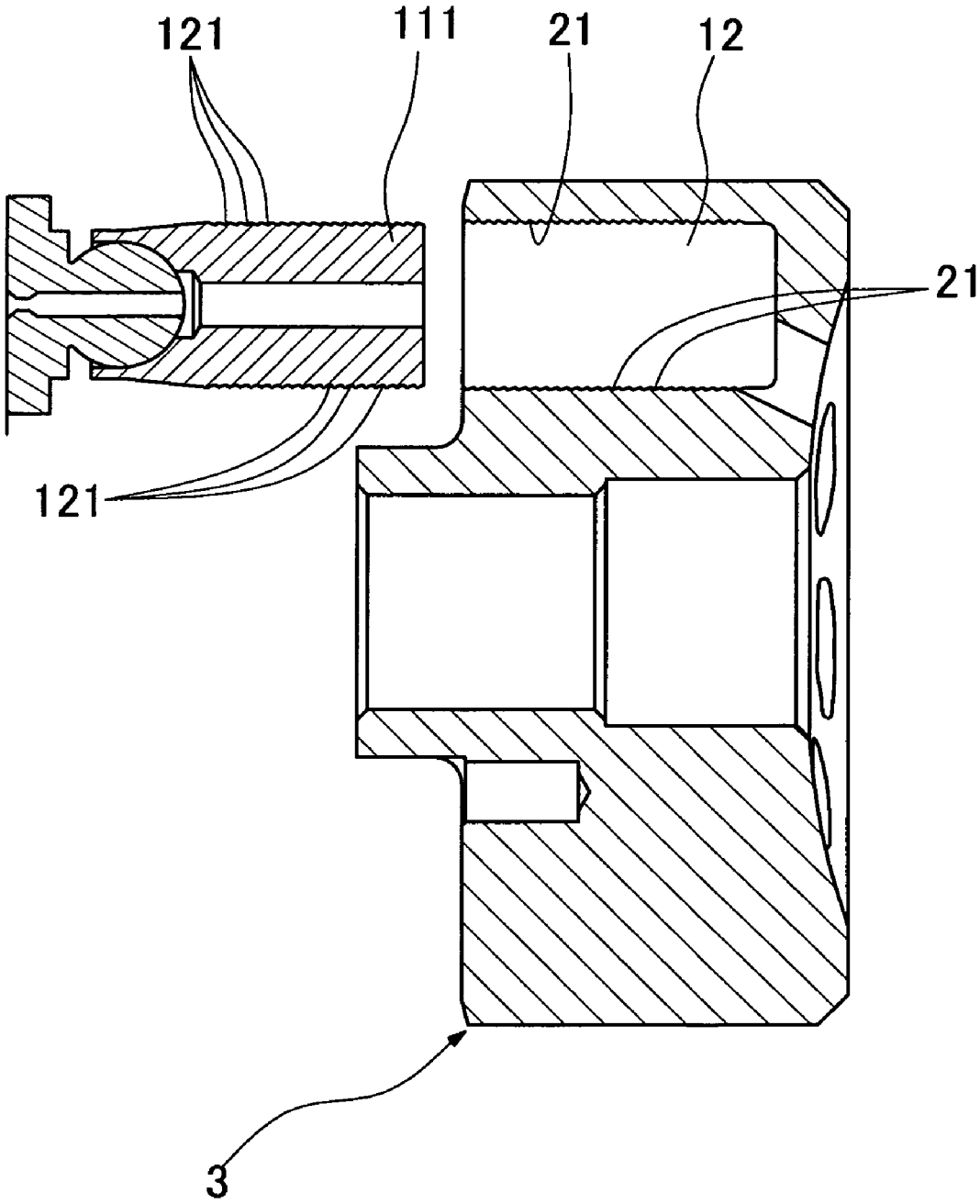
FIG. 6 A schematic sectional view of a cylinder block and a piston in another embodiment of the invention.

The function as a fluid bearing is needed particularly in a direction in which the pistons 11 are put in sliding movement under a large load, so that the moderately sloped surfaces 21*a* of the minute pits 21 are oriented to face toward the communication holes 12*a* at the bottom of the cylinder bores 12. Such orientation of the minute pits 21 can be made quite easily through adjustment of a bending angle of a distal end of a shot peening nozzle relative to inner sliding surfaces of cylinder bores on which the small shot balls are to be bombarded. In this manner, the moderately sloped surfaces 21*a* in the respective pits 21 can be oriented in an appropriate direction, producing wedge film effects of an oil film between relatively moving sliding surfaces. Namely, as shown in FIG. 5, each minute pit 21 on the inner surface of a cylinder bore 12 is filled with operating oil, which operating oil is squeezed and drawn toward a narrowing end of a moderately sloped surface 21*a* as indicated by arrow F by a piston 11 which is in a sliding movement in the direction of arrow S. As a result, the intervening operating oil acts as a wedge film to apply a pressure on the piston 11 in the direction of arrow M. Since a multitude of minute pits 21 are formed entirely around the inner periphery of each cylinder bore 12, the wedge film pressures are applied all around the piston 11 from the direction M, pushing the piston 11 toward a center axis. As a consequence, the pistons 11 which are coupled with the shoes 10 through the spherical joints 10*a* are centered in the respective cylinder bores 12 under the influence of the wedge film actions and thereby imparted with improved straight directionability in sliding motions.

In this manner, the minute pits 21 produce wedge film effects on a piston 11 which is in a discharging stroke inward of its cylinder bore 12. No wedge film effects are produced on a piston 11 which is in an intake stroke coming out of its cylinder bore 12. However, absence of the wedge film effects in an intake stroke would not give rise to any problem in particular because the piston 11 is operated under a relatively light load in an intake stroke. Nevertheless, it is important that a lubrication oil film be formed on sliding surfaces even when a piston is in an intake stroke. In this regard, by the lubricative effects of the minute pits 21 with a high oil retaining capacity, the piston 11 is put in a smooth sliding movement in each intake stroke.

As described above, the moderately sloped portions 21*a* of minute pits 21 are oriented in a direction in which a piston is put in a sliding movement under a larger load. Therefore, in a case where the hydraulic rotary machine is a hydraulic motor which is operated in an inverse fashion as compared with a hydraulic pump in the sense that pistons 11 are operated to suck in and push out high pressure oil instead of pressurizing operating oil as in a hydraulic pump, the moderately sloped portions of the minute pits 21 are oriented to face toward the swash plate 8 to produce the wedge film effects in outward strokes of a piston.

In the above-described embodiment, by way of example the minute pits 21 are formed on the side of the cylinder bores 12. However, as shown in FIG. 8, a multitude of minute oblique pits 121, each defining a moderately sloped surface and an acutely sloped surface, may be formed on the outer peripheral surface of each piston 111. Thus, the minute oblique pits may be formed on the side of a sliding surface on the inner periphery of a cylinder bore or a sliding surface on the outer periphery of a piston, or on both of sliding surface of a cylinder bore and a piston.

What is claimed is:

1. In a hydraulic rotary machine having within a casing a rotational shaft, a cylinder block rotationally interlocked with said rotational shaft and formed with a plural number of cylinder bores, and pistons slidably received in said cylinder bores and adapted to slide back and forth within said cylinder bores while said rotational shaft and said cylinder block are put in rotation in synchronism with each other:

a multitude of minute pits formed at least either on sliding surfaces on the side of said cylinder bores on said cylinder block or on sliding surfaces on the side of said pistons, each one of said minute pits being in an elliptical shape defining a moderately sloped surface in one side and an acutely sloped surface in the other side;

said moderately sloped surfaces of said minute pits being oriented to face a direction in which said pistons are put in sliding movement in said cylinder bores under a greater load than in the other direction.

2. A hydraulic rotary machine as set forth in claim 1, wherein said minute pits are formed by shot peening, bombarding a shot material against said sliding surfaces from an oblique direction to form thereon minute pits of an elliptical shape.

3. A hydraulic rotary machine as set forth in claim 2, wherein said shot material is in the form of small shot balls of a diameter between 10 μm and 1 mm.

4. A hydraulic rotary machine as set forth in claim 3, wherein said short material is bombarded against said sliding surfaces at an angle of incidence smaller than 60 degrees.

5. A hydraulic rotary machine as set forth in claim 1, wherein said minute pits are formed on sliding surfaces on the side of said cylinder bores.

6. A hydraulic rotary machine as set forth in claim 1, wherein said hydraulic rotary machine is a hydraulic pump having said cylinder bores alternately connected to an intake port and a discharge port by rotation of said cylinder block, said minute pits being formed at least on sliding surfaces on the side of said cylinder bores and having said moderately sloped surfaces oriented in such a way as to face in a direction toward said intake and discharge ports of said cylinder bores from the side of piston-protruding side of said cylinder bores.

7. A hydraulic rotary machine as set forth in claim 6, wherein said minute pits are formed in a higher density on sliding surfaces in the vicinity of piston-protruding ends of said cylinder bores.

8. A hydraulic rotary machine as set forth in claim 1, wherein said hydraulic rotary machine is a hydraulic motor having said cylinder bores alternately connected to a high-pressure port and a low-pressure port by rotation of said cylinder block, said minute pits being formed at least on sliding surfaces on the side of said cylinder bores and having said moderately sloped surfaces oriented to face in a direction toward piston-protruding ends of said cylinder bores from the side of said high- and low-pressure ports of said cylinder bores.

9. A hydraulic rotary machine as set forth in claim 1, wherein said minute pits are formed on inner peripheral sliding surfaces of said cylinder bores and on outer peripheral sliding surfaces of said pistons as well.

* * * * *